US006717114B2

(12) United States Patent
Austin et al.

(10) Patent No.: US 6,717,114 B2
(45) Date of Patent: Apr. 6, 2004

(54) CONVECTION FAN ASSEMBLY FOR A COOKING APPLIANCE

(75) Inventors: Kerry O. Austin, Ocoee, TN (US); Jeffrey K. McLeod, Riceville, TN (US); Jimmy C. Roden, Chattanooga, TN (US); Steven M. Swayne, Chattanooga, TN (US)

(73) Assignee: Maytag Corporation, Newton, IA (US)

( * ) Notice: Subject to any disclaimer, the term of this patent is extended or adjusted under 35 U.S.C. 154(b) by 89 days.

(21) Appl. No.: 10/014,902

(22) Filed: Dec. 14, 2001

(65) Prior Publication Data

US 2003/0111069 A1 Jun. 19, 2003

(51) Int. Cl.[7] ..... A21B 1/00
(52) U.S. Cl. ..... 219/400; 126/21 A
(58) Field of Search ..... 219/400, 702, 219/757, 396, 681; 126/21 A, 21 R, 273 A, 273 R, 299 D, 198; 210/175, 198.2; 34/218, 231

(56) References Cited

U.S. PATENT DOCUMENTS 1,543,740 A 6/1925 Wahle
3,627,440 A 12/1971 Wood
4,055,113 A 10/1977 Monroe
4,484,561 A 11/1984 Baggott et al.
4,867,132 A 9/1989 Yencha
4,884,946 A 12/1989 Belanger et al.
5,222,474 A 6/1993 Yencha, III
5,497,760 A 3/1996 Alden et al.
5,568,803 A * 10/1996 Brown ..... 126/21 A
5,744,029 A * 4/1998 Li et al. ..... 210/198.2
5,801,362 A * 9/1998 Pearlman et al. ..... 219/400
5,814,908 A 9/1998 Muszynski

* cited by examiner

*Primary Examiner*—Quang T. Van
(74) *Attorney, Agent, or Firm*—Diederiks & Whitelaw, PLC

(57) ABSTRACT

A fan assembly for a convection cooking appliance defines a self-contained unit including a housing, an internal fan unit, and a cover. The cover is provided with a centrally located, unobstructed opening for directing air to an inlet for the fan unit. The area of the inlet opening is equal to or larger than the sum of the cross-sectional inlet area of fan unit. During operation, air is drawn into the fan housing through the opening, directed radially outwardly through housing, and lead out through radial, peripherally spaced holes of the housing. The overall construction of the fan assembly eases manufacture and assembly, while defining a high performance convection system by establishing an efficient recirculating airflow, with relatively high air flow, pressure and velocity operating parameters.

20 Claims, 2 Drawing Sheets

CONVECTION FAN ASSEMBLY FOR A COOKING APPLIANCE

BACKGROUND OF THE INVENTION

1. Field of the Invention

The present invention pertains to the art of cooking and, more particularly, to a fan assembly provided in an oven cavity of a convection cooking appliance.

2. Discussion of the Prior Art

Conventional cooking appliances generally perform cooking operations through radiant heating developed from bake and/or broil elements. Such types of cooking appliances can take various forms, mainly ranges and wall ovens. Some radiant cooking appliances incorporate internal fans which can be used during certain cooking operations in order to generate an air flow within an oven cavity to enhance even cooking. Therefore, known cooking appliances can perform convection cooking operations. Convection cooking is actually prevalent in microwave and other types of ovens as well.

In convection cooking appliances, the air flow can be designed to recirculate within the oven cavity, flow through the oven cavity and be exhausted, or a combination of both of these configurations. For obvious reasons, it is desirable to enhance the efficiency of any air flow system in order to reduce associated operating costs, while minimizing the required fan size in order to produce an effective air flow rate. In addition, the manufacturing and assembly costs related to producing and installing an air flow system is of concern. Therefore, regardless of the existence of numerous convection systems in the art, there is always a need for an improved convection air flow system for use in a cooking appliance.

SUMMARY OF THE INVENTION

The present invention is directed to a fan assembly for a convection cooking appliance. Preferably, the cooking appliance includes a oven cavity and one or more heating elements for the oven cavity, while the fan assembly functions to develop a recirculating air flow within the oven cavity for convection purposes. In accordance with the invention, a recirculation fan assembly, preferably of the centrifugal type, is provided wherein air is drawn in along a central axis and expelled outwardly in a radial direction. The fan is essentially constituted by a rotating plate having blades which extend axially therefrom a relatively short distance.

Mounted over the fan is a cover or shroud which lies in relatively close proximity to the fan blades. About the outer periphery of the cover are arranged numerous exit holes to provide for exhaust and, at the center of the cover, a circular, unobstructed intake hole or opening is provided coaxial with the fan itself. This opening also has an associated diameter. Spaced a short axial distance from the opening within the fan housing, there is a circular zone which defines a fan inlet where no blades are present. In accordance with the invention, the opening is unobstructed and preferably circular, with the diameter of the opening in the fan cover not exceeding the diameter of the fan inlet. However, regardless of the actual shape of the opening, the area of the opening in the fan cover is equal to or larger than the sum of the cross-sectional areas of the mating fan as defined between the fan blades as air enters the blades.

Although the invention could be applied to both electric, gas and microwave cooking appliances, the most preferred embodiment of the invention takes the form of an electric range or wall oven. In any event, additional objects, features and advantages of the present invention will become more readily apparent from the following detailed description of a preferred embodiment when taken in conjunction with the accompanying drawings wherein like reference numerals refer to corresponding parts in the several views.

DETAILED DESCRIPTION OF THE PREFERRED EMBODIMENT

Figure 1:
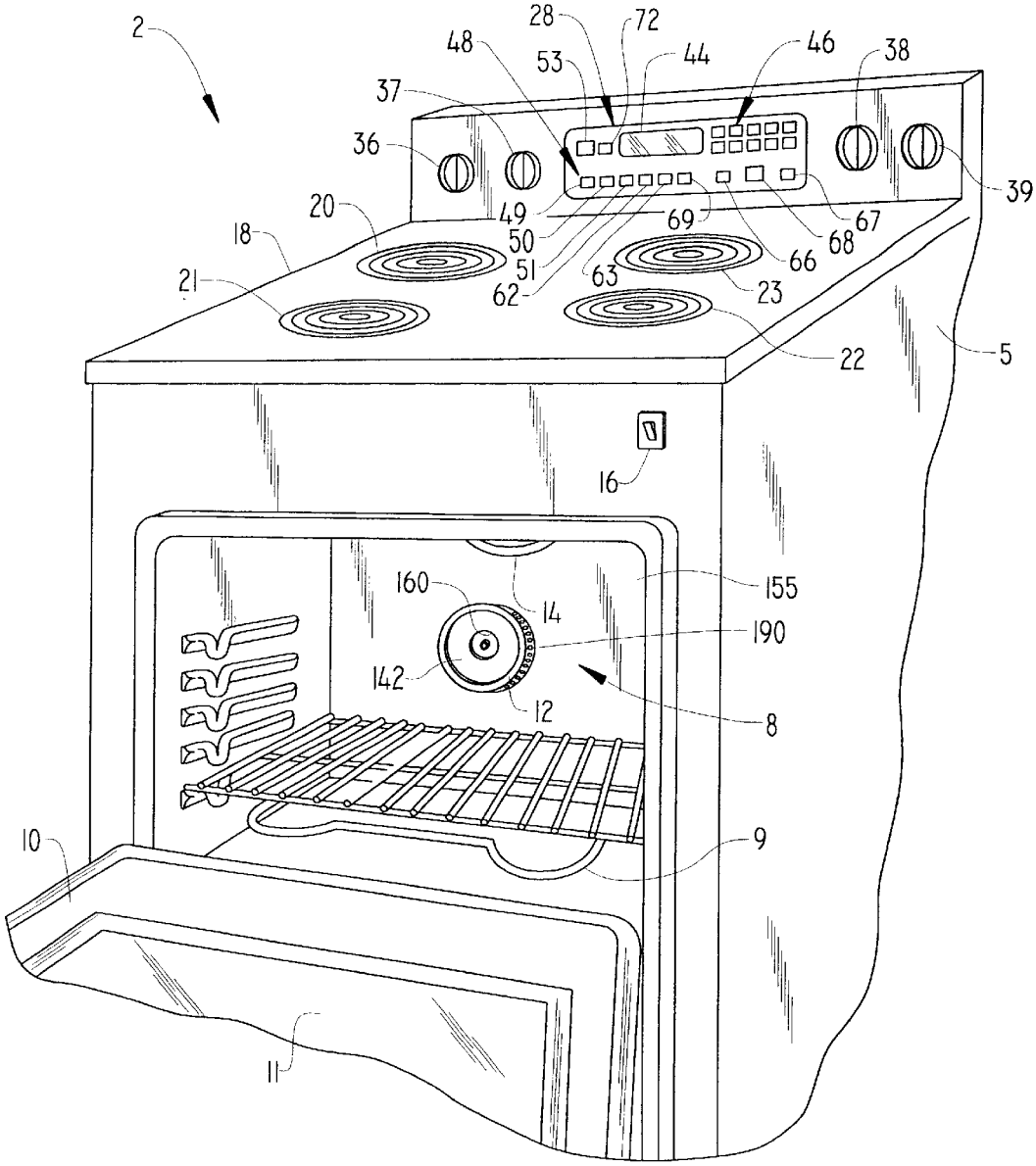
FIG. 1 is a partial perspective view of an electric range incorporating a convection fan assembly according to the invention.

With initial reference to FIG. 1, the invention is illustrated for use in connection with an electric range, generally indicated at 2. In the embodiment shown, electric range 2 includes a cabinet 5 within which is arranged an oven cavity 8 having an associated lower heating element 9 and a door 10 shown in an open condition wherein access to oven cavity 8 is permitted. The following description assumes that heating element 9 is of a conventional electric heating element design, but it is considered within the scope of this invention that heating element 9 may be of any conventional design. This figure also illustrates the presence of a viewing window 11 in door 10. Furthermore, within oven cavity 8, a fan assembly 12 and an upper, broil heating element, a part of which is shown at 14, are provided. In a manner known in the art, cabinet 5 is provided with a light switch 16 which functions to turn on a light (not shown) to illuminate oven cavity 8 upon the opening of door 10.

Cabinet 5 is also provided with an associated range top 18 which supports various spaced surface heating elements 20–23 in a manner known in the art. At an upper rear portion, cabinet 5 is provided with a control panel 28. Control panel 28 includes a plurality of knobs 36–39 for use in selectively activating and deactivating surface heating elements 20–23 respectively. In addition, control panel 28 is shown to include a central display 44, such as an LED or LCD display unit. Furthermore, control panel 28 is provided with a number pad generally indicated at 46 having buttons for the numbers zero (0) through nine (9), with the zero (0) button also functioning as a reset control button.

Although the particular features incorporated into electric range 2 could vary greatly within the scope of the present invention, for the sake of completeness in describing a preferred form of the invention, control panel 28 of range 2 is also shown to include a lower row of control buttons generally indicated at 48 which are provided to select various operational modes for range 2. For instance, the row of control buttons 48 can be used to select bake, broil and clean modes for range 2 through respective buttons 49–51. In the particular embodiment shown, an additional convection baking mode, which is essentially defined by a baking mode with the further activation of fan assembly 12, can also be selected through button 53.

In the embodiment shown, the user may program the operation of range 2 through the use of the lower row of control buttons 48, control button 53 and numeric pad 46, as well as timer buttons 62 and 63. Furthermore, buttons 66 and 67 are provided to enable a consumer to set desired countdown and clock times, in combination with numeric pad 46, respectively. Button 68 performs a stop or clear control function, while button 69 enables a consumer to turn on the oven light without opening door 10 such that oven cavity 8 can be selectively viewed through window 11. Finally, an Auto Set button 72 is provided and can be used to perform various programming functions as will also be discussed below. Of course, although various buttons are described for use on control panel 28, other types of control switches could equally be employed.

Figure 2:
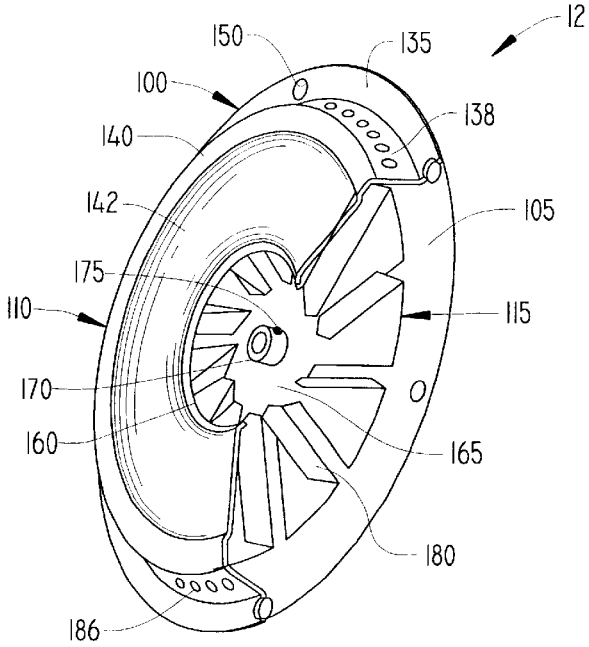
FIG. 2 is a perspective view of the convection fan assembly, with a portion thereof being cut-away to depict internal structure.

In general, with the exception of fan assembly 12, the remainder of the structure of cooking appliance 2 as described above is known in the art, as well as its corresponding operation. Of course, convection cooking appliances are also widely known in the art. Therefore, the present invention is particularly directed to the specific structure and operation of fan assembly 12 as will now be discussed in full detail with reference to FIGS. 2 and 3.

As shown, fan assembly 12 includes a housing 100, composed of a backplate 105 and a fan cover 110, and an internal fan unit 115. As shown, backplate 105 is generally in the form of a flat plate having a central rear aperture 125 through which a shaft 127 of a preferably variable speed drive motor (not shown) is adapted to project. Fan cover 110 includes an outer peripheral flange portion 135, an annular, radially sloping portion 138, an in-turned flange 140 and a front plate portion 142. Outer peripheral flange portion 135 is fixed to backplate 105, such as through welding or the like. A plurality of holes 150 are provided at spaced circumferential positions about the connection between outer peripheral flange portion 135 and backplate 105 for the purpose of receiving attachment screws (not shown) used to secure fan assembly 12 to the back wall 155 (see FIG. 1) of oven cavity 8. Of course, it should be readily recognized that a wide range of attachment arrangements could be employed without departing from the invention.

Front plate portion 142 is formed with a central opening 160 which leads to an inlet for fan assembly 12. As shown, opening 160 is unobstructed, i.e., there is preferably no mesh or perforated element there across or, if some element is provided, the structure must not unduly restrict or impede the air flow. Opening 160 leads into housing 100 and to fan unit 115. Fan unit 115 includes a back wall 165 having fixed thereto a sleeve 170 into which drive shaft 127 projects. A set screw 175 is provided in order to secure drive shaft 127 within sleeve 170 such that rotation of drive shaft 127 functions to correspondingly rotate fan unit 115. Projecting forward from back wall 165 are a plurality of thin, radially extending and circumferentially spaced vanes or blades 180. The innermost radial portion 182 of each blade 180, as perhaps best shown in FIG. 3, slopes towards back wall 165. As also shown, annular, radially sloping portion 138 is provided with a plurality of holes 186 which constitute outlet ports for fan assembly 12.

Figure 3:
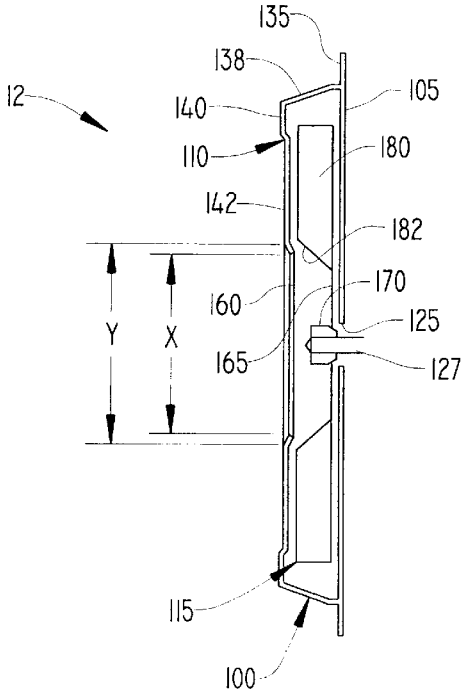
FIG. 3 is a cross-sectional side view of the convection fan assembly of FIG. 2.

With this overall arrangement, an inlet diameter of fan unit 115 is defined by the distance X as shown in FIG. 3. In addition, opening 160 defines an overall inlet for fan assembly 12, with the diameter of opening 160 being represented by the distance Y as also shown in FIG. 3. Clearly, opening 160 provides an unobstructed passage for inlet air directly over the center of fan unit 115. In accordance with the invention, the area of opening 160 is preferably equal to or larger than the total cross-sectional inlet area of fan unit 115, defined as the sum of the areas between the various blades 180 as the air enters fan unit 115. In other words, at the innermost point of each pair of adjacent fan blades 180, there is a cross-sectional area defined by the axial length of each fan blade 180 and an arcuate section of both fan cover 110 and the particular fan blade 180. The sum of all these cross-sectional areas formed by fan assembly 12 is essentially equal to the diameter of the inlet of fan unit 115 times the axial length of the fan blade 180 minus the amount of cross-section area of the fan blades 180 themselves. In addition, in accordance with the most preferred form of the invention wherein opening 160 is circular, the diameter of opening 160 does not exceed the inlet diameter of fan unit 115.

Fan assembly 12 is mounted in place at outer peripheral flange portion 135, with annular, radially sloping portion 138 projecting through an enlarged opening 190 provided in back wall 155 of oven cavity 8. During operation of fan assembly 12, air is drawn into inlet opening 160, directed into the directly adjacent or juxtapose fan inlet, re-directed radially outwardly through housing 100, and lead out holes 186. In this manner, air within oven cavity 8 is recirculated during operation of cooking appliance 2, with the air being effectively directed substantially uniformly about oven cavity 8 and forward due to the angling of annular, radially sloping portion 138. The construction of fan assembly 12 and its mounting configuration eases manufacture and assembly. In addition, the overall construction establishes a high performance convection system by establishing an efficient recirculating airflow, with relatively high air flow, pressure and velocity operating parameters.

Although described with reference to a preferred embodiment of the invention, it should be readily apparent that modifications can be made to the invention as described without departing from the spirit thereof. For instance, although the invention has been described in connection with reference electric range 2, the invention is equally applicable to other cooking appliances models, including wall and microwave ovens, and other types of heat sources, including gas. Furthermore, although opening 160 is preferably circular, it can take various polygonal shapes while maintaining the relative area relationship with the fan inlet. In any event, the invention is only intended to be limited by the scope of the following claims.

We claim:

1. In a convection cooking appliance including an oven cavity, at least one heat source for heating the oven cavity, and a control panel for setting a desired cooking operation, a fan assembly comprising:

a housing including front, back and peripheral side portions, said housing being secured within the cooking appliance, with the front and peripheral side portions projecting into the oven cavity;

an inlet opening provided in the front portion of the housing, with the inlet opening having a diameter and an intake area;

a fan unit rotatably mounted within the housing, said fan unit including a plurality of blades and a fan inlet juxtapose the inlet opening of the housing, wherein each adjacent pair of said plurality of blades defines an area portion of the fan inlet and a sum of the area portions for the plurality of blades defining a total inlet area for the fan unit, with the intake area being at least equal to the total inlet area; and a plurality of air exit holes provided in the peripheral side portion of the housing wherein, during operation of said fan assembly, a flow of air is drawn into the housing through the inlet opening, lead to the fan inlet, re-directed within the housing, and directed out the exit holes.

2. The fan assembly according to claim 1, wherein the intake area is greater than the total inlet area.

3. The fan assembly according to claim 1, wherein the fan inlet has a diameter which is equal to or exceeds a diameter of the inlet opening.

4. The fan assembly according to claim 1, wherein the back portion of the housing is defined by a backplate, and both the front and peripheral side portions of the housing are defined by a fan cover, said fan cover including a peripheral flange portion connected to the backplate, said housing being secured within the cooking appliance about the peripheral flange portion.

5. The fan assembly according to claim 4, wherein the oven cavity has a back wall provided with an enlarged opening, said peripheral flange portion being fixed behind the back wall.

6. The fan assembly according to claim 5, wherein the peripheral side portion of the housing projects through the enlarged opening.

7. The fan assembly according to claim 1, wherein the side peripheral portion of the housing is defined by an annular, radially sloping portion of the fan cover.

8. The fan assembly according to claim 7, wherein the plurality of air exit holes are provided about the annular, radially sloping portion.

9. The fan assembly according to claim 1, wherein the fan unit is positioned between the front and back portions of the housing.

10. In a convection cooking appliance including an oven cavity having a back wall provided with an enlarged opening, at least one heat source for heating the oven cavity, and a control panel for setting a desired cooking operation, a fan assembly comprising:

a housing including front, back and peripheral side portions, wherein the back portion of the housing is defined by a backplate, both the front and peripheral side portions of the housing are defined by a fan cover having a peripheral flange portion secured to the backplate, and the peripheral side portion of the housing is defined by an annular, radially sloping portion of the fan cover, said housing being secured within the cooking appliance about the peripheral flange portion, with the front and peripheral side portions projecting into the oven cavity;

an inlet opening provided in the front portion of the housing, with the inlet opening having a diameter and an intake area;

a fan unit rotatably mounted within the housing, said fan unit including a plurality of blades and a fan inlet juxtapose the inlet opening of the housing; and a plurality of air exit holes provided in the annular, radially sloping portion of the housing wherein, during operation of said fan assembly, a flow of air is drawn into the housing through the inlet opening, lead to the fan inlet, re-directed within the housing, and directed out the exit holes.

11. The fan assembly according to claim 10, wherein the oven cavity has a back wall provided with an enlarged opening, said peripheral flange portion being fixed behind the back wall.

12. The fan assembly according to claim 11, wherein the fan inlet has a diameter and a fan inlet area, said intake area being at least equal to the fan inlet area.

13. The fan assembly according to claim 11, wherein the peripheral side portion of the housing projects through the enlarged opening.

14. The fan assembly according to claim 10, wherein each adjacent pair of said plurality of blades defines an area portion of the fan inlet and a sum of the area portions for the plurality of blades defining a total inlet area for the fan unit, with the intake area being at least equal to the total inlet area.

15. The fan assembly according to claim 14, wherein the intake area is greater than the total inlet area.

16. The fan assembly according to claim 14, wherein the fan inlet has a diameter which is equal to or exceeds the diameter of the inlet opening.

17. The fan assembly according to claim 10, wherein the fan unit is positioned between the front and back portions of the housing.

18. A method of recirculating air in an oven cavity of a cooking appliance comprising:

drawing a flow of air from within the oven cavity into an intake opening of a fan housing exposed to oven cavity;

directing the flow of air into a fan inlet, having a diameter which is at least equal to a diameter of the intake opening but an area which is no greater than an area of the intake opening, arranged juxtopose the intake opening;

re-directing the flow of air radially outwardly within the fan housing; and expelling the flow of air from the fan housing.

19. The method of claim 18, wherein the flow of air is expelled from the fan housing both radially outwardly and forwardly into the oven cavity.

20. The method of claim 18, further comprising: securing the fan housing relative to the oven cavity, with a backplate portion of the fan housing being arranged behind the oven cavity, and both front and peripheral side portions of the fan assembly projecting into the oven cavity.

* * * * *